US010231902B2

(12) United States Patent
Yueh

(10) Patent No.: US 10,231,902 B2
(45) Date of Patent: Mar. 19, 2019

(54) MESSAGE APPARATUS

(71) Applicants: Oivita Creative Co., Ltd., Taipei (TW); Chao-Yu Yueh, Taipei (TW)

(72) Inventor: Chao-Yu Yueh, Taipei (TW)

(73) Assignees: OIVITA CREATIVE CO., LTD., Taipei (TW); Chao-Yu Yueh, Taipei (TW)

( * ) Notice: Subject to any disclaimer, the term of this patent is extended or adjusted under 35 U.S.C. 154(b) by 267 days.

(21) Appl. No.: 15/361,100

(22) Filed: Nov. 25, 2016

(65) Prior Publication Data

US 2017/0224580 A1 Aug. 10, 2017

(30) Foreign Application Priority Data

Feb. 5, 2016 (TW) ..... 105103956 A

(51) Int. Cl.
*A61H 23/02* (2006.01)
*A61H 19/00* (2006.01)

(52) U.S. Cl.
CPC ..... *A61H 23/0254* (2013.01); *A61H 19/00* (2013.01); *A61H 19/44* (2013.01); *A61H 2201/0153* (2013.01); *A61H 2201/0157* (2013.01); *A61H 2201/0192* (2013.01); *A61H 2201/123* (2013.01); *A61H 2201/1207* (2013.01); *A61H 2201/149* (2013.01); *A61H 2201/50* (2013.01); *A61H 2201/5038* (2013.01)

(58) Field of Classification Search
CPC ..... A61H 19/00; A61H 19/40; A61H 19/44; A61H 21/00
USPC ..... 600/38; 601/46
See application file for complete search history.

(56) References Cited

U.S. PATENT DOCUMENTS

| | | | | |
|---|---|---|---|---|
| 7,828,717 | B2 * | 11/2010 | Lee | A61H 19/34 600/38 |
| 8,419,664 | B2 * | 4/2013 | Knyrim | A61H 19/44 600/38 |
| 9,066,843 | B1 * | 6/2015 | Greco | A61H 19/44 |
| 2006/0287616 | A1 * | 12/2006 | Nan | A45D 34/041 601/17 |
| 2009/0099413 | A1 * | 4/2009 | Kobashikawa | A61H 19/34 600/38 |
| 2017/0281459 | A1 * | 10/2017 | Cirillo-Schmidt | A61H 19/44 |

* cited by examiner

*Primary Examiner* — Samuel G Gilbert
(74) *Attorney, Agent, or Firm* — McClure, Qualey & Rodack, LLP

(57) ABSTRACT

A massage apparatus is provided. The massage apparatus includes a housing, an active assembly and a flexible component. The active assembly, which is fixed on one side of the housing approximately along an axis, includes an adjusting motor, a plurality of adjustable elements and a plurality of supporting elements. The flexible component clads the active assembly. The adjustable elements surrounding the axis are located outside the adjusting motor. The supporting elements surrounding the axis are located outside the adjustable elements and correspondingly coupled to the adjustable elements. The adjusting motor drives the adjustable elements to move toward directions different form the axis so that the support elements adjust the flexible component toward the directions different form the axis.

5 Claims, 3 Drawing Sheets

MESSAGE APPARATUS

CROSS REFERENCE TO RELATED APPLICATIONS

This Non-provisional application claims priority under 35 U.S.C. § 119(a) on Patent Application No. 105103956 filed in Taiwan, Republic of China on Feb. 5, 2016, the entire contents of which are hereby incorporated by reference.

BACKGROUND

1. Technical Field

The disclosure relates to a massage apparatus, in particular, to a sexual massage apparatus.

2. Description of Related Art

There is a variety of massage apparatus existing on the market. In general, the massage apparatus can be divided into a manual massage apparatus or an electric massage apparatus, wherein the electric massage apparatus is more popular than the manual massage apparatus.

The conventional electric massage apparatus stimulates the user only with vibrating or rotating that may reduce the feeling of the user. It is therefore an important subject of the invention to provide a massage apparatus has the function that different from the action of vibrating or rotating to satisfy the user.

SUMMARY OF THE INVENTION

In view of the foregoing, the invention is to provide a massage apparatus, which has a variety of intensity to satisfy the user by changing the outward or the volume of the massage apparatus.

To achieve the above, a massage apparatus includes a housing, an active assembly and a flexible component. The active assembly, which is fixed on one side of the housing approximately along an axis, includes an adjusting motor, a plurality of adjustable elements and a plurality of supporting elements. The adjustable elements are surrounding the axis and located outside of the adjusting motor. The supporting elements are surrounding the axis, located outside of the adjustable element and correspondingly coupled to the adjustable elements. The flexible component is cladding the active assembly. The adjusting motor drives the adjustable elements to move toward directions different form the axis so that the flexible component is adjusted by the supporting element toward the directions different form the axis.

As mentioned above, the outward of the massage apparatus is transformed by adjusting the active assembly that is different from the action of vibrating or rotating. The flexible component is comfortable to contact with the user. More detail, the flexible component is stretched by the active assembly, which is driven by the adjusting motor, to change the volume or the outward of the massage apparatus so as to rub the body of the user.

The detailed technology and preferred embodiments implemented for the subject invention are described in the following paragraphs accompanying the appended drawings for people skilled in this field to well appreciate the features of the claimed invention.

BRIEF DESCRIPTION OF THE DRAWINGS

The parts in the drawings are not necessarily drawn to scale, the emphasis instead being placed upon clearly illustrating the principles of at least one embodiment. In the drawings, like reference numerals designate corresponding parts throughout the various diagrams, and all the diagrams are schematic.

DETAILED DESCRIPTION

Figure 1:
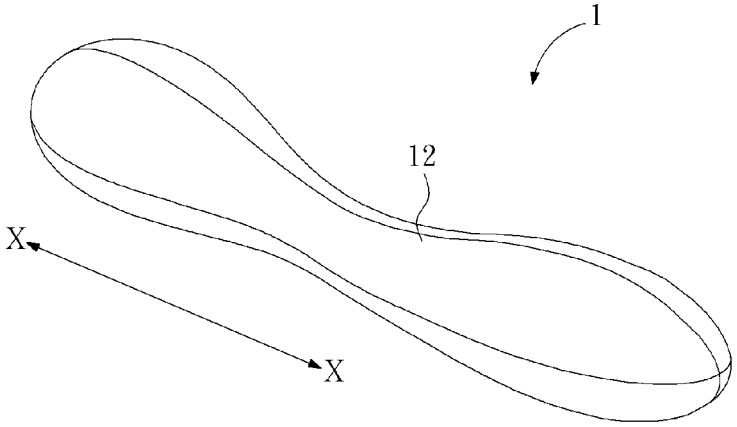
FIG. 1 is schematic diagram showing a massage apparatus according to an embodiment of the invention.

The parts in the drawings are not necessarily drawn to scale, the emphasis instead being placed upon clearly illustrating the principles of at least one embodiment. In the drawings, like reference numerals designate corresponding parts throughout the various diagrams, and all the diagrams are schematic.

Figure 2:
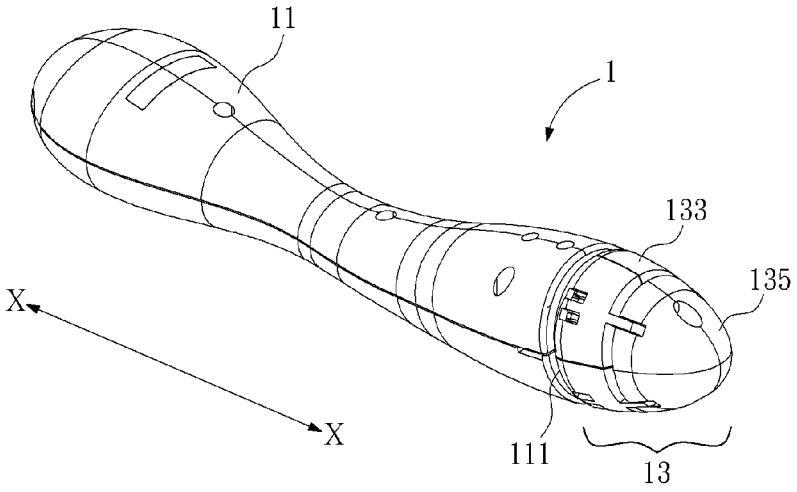
FIG. 2 is another schematic diagram showing the massage apparatus according to the embodiment of the invention.

Referring to FIG. 1 and FIG. 2, a massage apparatus 1 includes a housing 11, an active assembly 13, a vibrating motor 15, a battery 17, a printed circuit board (PCB) 19 and a flexible component 21. The active assembly 13 is fixed on one side of the housing 11 approximately along an axis X. The vibrating motor 15, the battery 17 and the PCB 19 are located in the housing. The flexible component 21 clads the housing 11 and the active assembly 13. In the embodiment, the material of the flexible component 21 is silicon or the like.

Figure 3:
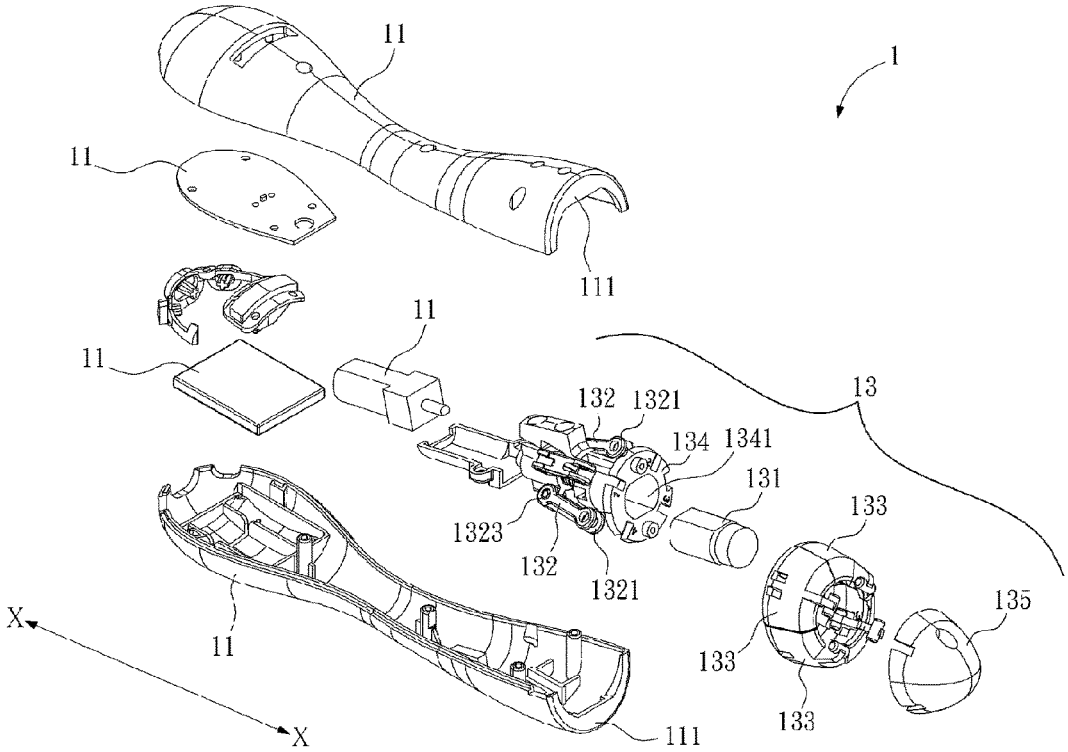
FIG. 3 is an explosion diagram showing the massage apparatus according to the embodiment of the invention.

Referring to FIG. 3, the active assembly 13 includes an adjusting motor 131, a plurality of adjustable element 132, a plurality of supporting element 133, a containing element 134 and a sealing element 135. The adjusting motor 131 is contained in the containing element 134. The adjustable elements 132 surrounding the axis X are disposed outside the adjusting motor 131. Each of the adjustable elements 132 has a first side 1321 and a second side 1323. The supporting elements 133 surrounding the axis X are located outside the adjustable element 132. Each of the supporting elements 133 is connected to the first side 1321 of the corresponding adjustable element 132. In the embodiment, the active assembly 13 has four adjustable elements 132 and four supporting elements 133. However, the number of adjustable elements 132 and the number of supporting elements 133 are not limited in the other embodiment.

The containing element 134 has an embedded opening 1341, which is fixed on one side 111 of the housing 11 approximately along the axis X. The adjusting motor 131 is located in the containing element 134 through the embedded opening 1341. The sealing element 135 is removable connected to the containing element 134 so as to fix the adjusting motor 131. The adjusting motor 131 is pulled out from the containing element 134 through the embedded opening 1341 after the sealing element 135 is removed. The battery 17 is electrically connected to the adjusting motor 131 and the vibrating motor 15 through the PCB 19. The battery 17 provides a power to the adjusting motor 131 and the vibrating motor 15 via the PCB 19.

Figure 4:
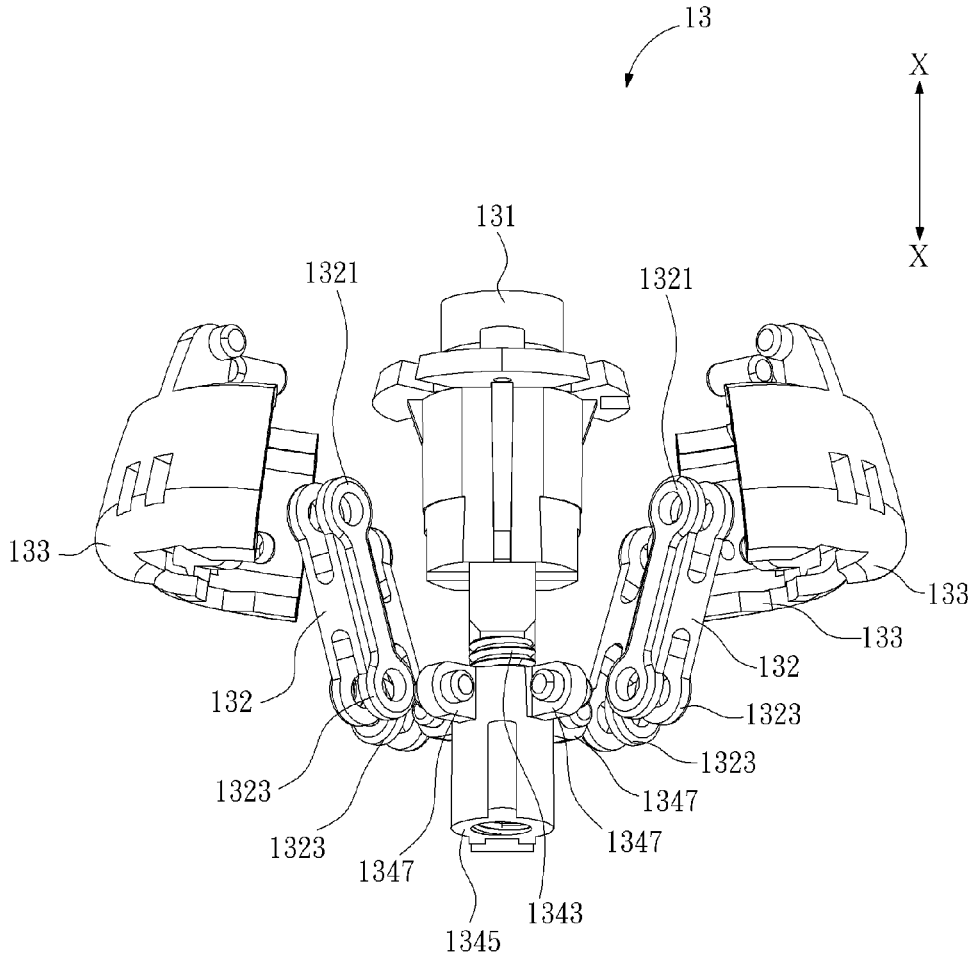
FIG. 4 is an explosion diagram showing an active assembly of the massage apparatus according to the embodiment of the invention.

Referring to FIG. 4, the containing element 134 further has a whorl shaft 1343, a whorl tube 1345 and a plurality of turning parts 1347. The whorl shaft 1343 is passing through the whorl tube 1345. One side of the whorl shaft 1343 is connected to the adjusting motor 131. The turning parts 1347 surrounding the axis X are located outside the whorl tube 1345. Each of the turning parts 1347 is connected to the second side 1323 of the corresponding adjusting element 132. In the embodiment, the containing element 134 has four turning parts 1347. However, the number of turning part 1347 is not limited in the other embodiment.

When the massage apparatus 1 is enabled, the battery 17 provides the power to the adjusting motor 131 and the vibrating motor 15 so as to enable the adjusting motor 131 and the vibrating motor 15. The massage apparatus 1 results in vibration when the vibrating motor 15 is enabled. The strength of the vibration can be adjusted by controlling the adjusting motor 131. The active assembly 13 is driven for operating by the adjusting motor 131 so as to stretch the flexible component 21 to change the outward or the volume of the massage apparatus 1.

More detail, when the massage apparatus is enabled, the adjustment motor 131 drives the whorl shaft 1343 moving into the whorl tube 1345 so that the adjustable elements 132 driven by the turning parts 1347 to move toward directions different form the axis X, and then the flexible component 21 is adjusted by the supporting element 133 to move toward the directions different form the axis X.

In summary, the outward of the massage apparatus is transformed by adjusting the active assembly that is different from the action of vibrating or rotating. The flexible component is comfortable to contact with the skin of the user. More detail, the massage apparatus is a sexual massage apparatus that the flexible component is stretched by the active assembly, which is driven by the adjusting motor, to change the volume or the outward of the massage apparatus so as to rub the body of the user.

Even though numerous characteristics and advantages of certain inventive embodiments have been set out in the foregoing description, together with details of the structures and functions of the embodiments, the disclosure is illustrative only. Changes may be made in detail, especially in matters of arrangement of parts, within the principles of the present disclosure to the full extent indicated by the broad general meaning of the terms in which the appended claims are expressed.

What is claimed is:

1. A massage apparatus comprising:

a housing;

an active assembly that is fixed on one side of the housing along an axis, comprising:

an adjusting motor;

at least one adjustable element having a first side and a second side that is surrounding the axis and located outside of the adjusting motor;

a containing element which receives the adjusting motor therein, comprising:

a whorl tube;

a whorl shaft that is passing through the whorl tube and connected to the adjusting motor; and at least one turning part that is surrounding the axis and correspondingly connected to the second side of the at least one adjustable element;

wherein the adjusting motor drives the whorl shaft to move into the whorl tube;

wherein the turning part drives the at least one adjustable element toward the directions different form the axis; and at least one supporting element that is surrounding the axis, located outside of the at least one adjustable element and correspondingly coupled to the at least one adjustable element; and a flexible component that is cladding the active assembly;

wherein the adjusting motor drives the at least one adjustable element to move toward directions different form the axis so that the flexible component is adjusted by the supporting element to move toward the directions different form the axis.

2. The massage apparatus defined in claim 1, further comprising:

a vibrating motor that is disposed in the housing.

3. The massage apparatus defined in claim 2, further comprising:

a battery that is electrically connected to the adjusting motor and the vibrating motor to provide a power.

4. The massage apparatus defined in claim 1, wherein the active assembly further comprising:

a sealing element that is removable connected to the containing element to fix the adjusting motor.

5. The massage apparatus defined in claim 1, wherein the containing element is fixed on one side of the housing along the axis.

* * * * *